US009371751B2

(12) United States Patent
Bram

(10) Patent No.: US 9,371,751 B2
(45) Date of Patent: Jun. 21, 2016

(54) TWO STROKE COMBUSTION ENGINE

(75) Inventor: Johan Bram, Kalmar (SE)

(73) Assignee: Construction Tools PC AB, Kalmar (SE)

( * ) Notice: Subject to any disclaimer, the term of this patent is extended or adjusted under 35 U.S.C. 154(b) by 1473 days.

(21) Appl. No.: 12/311,885

(22) PCT Filed: Nov. 27, 2007

(86) PCT No.: PCT/SE2007/001043
§ 371 (c)(1),
(2), (4) Date: Apr. 16, 2009

(87) PCT Pub. No.: WO2008/066448
PCT Pub. Date: Jun. 5, 2008

(65) Prior Publication Data

US 2010/0170485 A1 Jul. 8, 2010

(30) Foreign Application Priority Data

Nov. 27, 2006 (SE) ..... 0602508-4

(51) Int. Cl.
*F02B 25/00* (2006.01)
*F02B 25/06* (2006.01)
*F01M 3/00* (2006.01)
(Continued)

(52) U.S. Cl.
CPC ..... *F01M 3/00* (2013.01); *F01M 11/08* (2013.01); *F02B 17/005* (2013.01); *F02B 25/18* (2013.01); *F02B 33/04* (2013.01); *F02F 1/22* (2013.01); *F02F 7/0036* (2013.01); *F02B 2075/025* (2013.01); *F02B 2075/125* (2013.01)

(58) Field of Classification Search
USPC ..... 123/572, 573, 198 E, 574, 559.1, 195 R, 123/196 R, 184.21, 41.86, 52.4, 51 A, 73 A, 123/73 AA, 73 R; 55/385.4, 484, 483, 482, 55/DIG. 19, 401, 406, 320; 184/6.11, 11.1, 184/6.17
See application file for complete search history.

(56) References Cited

U.S. PATENT DOCUMENTS 1,808,384 A 6/1931 Taneyhill
3,916,851 A * 11/1975 Otani ..... 123/73 A
(Continued)

FOREIGN PATENT DOCUMENTS

DE 3731250 C1 10/1988
GB 733743 7/1955
(Continued)

*Primary Examiner* — Lindsay Low
*Assistant Examiner* — Syed O Hasan
(74) *Attorney, Agent, or Firm* — Mark P. Stone

(57) ABSTRACT

The invention related to a two-stroke internal combustion engine (1), comprising a crankcase (2), which has an air intake (3), and at least one cylinder (4), which is connected to the crankcase (2) and which, together with a piston (5) arranged therein, defines a combustion chamber (6). The cylinder (4) has at least one air inlet (7), which via an air duct (8) communicates with the crankcase (2), in which a mixture of air and lubricating oil and fuel, if any, is contained. The air duct (8) is connected to the crankcase (2) via a separator (10) for cleaning of air coming from the crankcase (2) from lubricating oil and fuel, if any. The separator (10) has a centrifugal chamber (11), in which the lubricating oil and the fuel, if any, in a circulating motion are thrown outwards to a circumferential wall (12) and thus substantially cleaned air is passed, through a chamber outlet (13), which with respect to said circulating motion is a radially inner outlet, to said air duct (8) to be supplied to the combustion chamber (6) through the air inlet (7).

12 Claims, 3 Drawing Sheets

(51) Int. Cl.

| | |
|---|---|
| ***F01M 11/08*** | (2006.01) |
| ***F02B 17/00*** | (2006.01) |
| ***F02B 25/18*** | (2006.01) |
| ***F02B 33/04*** | (2006.01) |
| ***F02F 1/22*** | (2006.01) |
| ***F02F 7/00*** | (2006.01) |
| *F02B 75/02* | (2006.01) |
| *F02B 75/12* | (2006.01) |

(56) References Cited

U.S. PATENT DOCUMENTS

| | | | | | |
|---|---|---|---|---|---|
| 4,481,910 | A | | 11/1984 | Sheaffer | |
| 5,261,380 | A | * | 11/1993 | Romano | 123/573 |
| 5,329,913 | A | * | 7/1994 | Suzuki et al. | 123/573 |
| 5,542,402 | A | * | 8/1996 | Lee et al. | 123/573 |
| 2002/0117130 | A1 | * | 8/2002 | Toda | 123/73 A |
| 2004/0244737 | A1 | * | 12/2004 | Araki et al. | 123/73 A |

FOREIGN PATENT DOCUMENTS

| | | | |
|---|---|---|---|
| GB | 2130642 | A | 6/1984 |
| JP | 54-113718 | | 9/1979 |
| JP | 59-65556 | | 4/1984 |
| JP | 62113809 | A | 5/1987 |
| JP | 62113812 | A | 5/1987 |
| WO | WO 98/34016 | A | 8/1998 |
| WO | WO 01/81740 | A1 | 11/2001 |

* cited by examiner

TWO STROKE COMBUSTION ENGINE

FIELD OF THE INVENTION

The invention relates to a two-stroke internal combustion engine, comprising a crankcase, which has an air intake, and at least one cylinder, which is connected to the crankcase and which, together with a piston arranged therein, defines a combustion chamber. The cylinder has at least one air inlet, which via an air duct communicates with the crankcase, in which a mixture of air and lubricating oil and fuel, if any, is contained.

BACKGROUND ART

U.S. Pat. No. 4,481,910 discloses a two-stroke combustion engine as described by way of introduction. In this engine, what is referred to as stratified charge is provided by supplying to the combustion chamber more or less clean air and a fuel-air mixture from a carburettor which is connected to the crankcase. The carburettor comprises a valve, which opens at a negative pressure in the crankcase and closes at a positive pressure in the same. When a positive pressure occurs in the crankcase, fuel-air mixture is forced out of the crankcase through a short suction duct and a long air duct. Since, during a preceding engine cycle with a negative pressure in crankcase, the air duct has been filled with clean air through an extra air shutter, almost clean air is forced through the air inlet into the cylinder of the engine and, in this way, the cylinder is scavenged with a minimum of fuel leakage. This results in improved fuel economy as well as cleaner exhaust gases.

OBJECT OF THE INVENTION

The stratified-charged engine, which is known from U.S. Pat. No. 4,481,910, suffers from two drawbacks which the invention is to eliminate. The first drawback is that the prior art solution makes cold starting difficult, requiring a rich fuel-air mixture since the extra air shutter takes in outdoor air which is quite unaffected by a possibly richer fuel-air mixture in the crankcase. The second drawback is that the prior art solution is relatively bulky. This is due not only to the function-related long air duct but also to the air, which flows into it through the extra air shutter, first having to be cleaned. This requires either an extra air filter in addition to an ordinary air filter for the engine, or an extra air conduit from an ordinary air filter to said air shutter.

Taken together, this makes the engine according to U.S. Pat. No. 4,481,910 less suitable for use as a drive unit especially in machines, in which weight and outer dimensions are important, such as in hand-held power tools. The object of the invention is to eliminate the drawbacks of the prior art solution while at the same time the advantages thereof are maintained.

SUMMARY OF THE INVENTION

According to the invention, this object is achieved by a two-stroke internal combustion engine as described by way of introduction by the air duct being connected to the crankcase via a separator for cleaning of air coming from the crankcase from lubricating oil and fuel, if any, said separator having a centrifugal chamber, in which the lubricating oil and the fuel, if any, in a circulating motion are thrown outwards to a circumferential wall and thus substantially cleaned air is passed, through a chamber outlet, which with respect to said circulating motion is a radially inner outlet, to said air duct to be supplied to the combustion chamber through the air inlet.

The invention thus makes it possible to run the engine with a single air intake and use a short air duct for the air to the cylinder. This means that only one ordinary air filter is required, and no extra air conduit, and also that the air duct between the crankcase and the cylinder can be very short.

The centrifugal chamber of the separator suitably has, with respect to said circulating motion, an axially first end portion, which by an inlet duct is connected to the crankcase. The connection at an end portion of the centrifugal chamber significantly facilitates efficient production of said circulating motion in the same, particularly if the inlet duct also connects substantially tangentially to the centrifugal chamber. Then a mixture of air and lubricating oil and fuel, if any, flowing into the chamber is in a very natural way put in a circulating motion along the circumferential wall of the chamber, and in a radially inner portion of the chamber a very lean fuel-air mixture is obtained to be discharged through the radially inner chamber outlet.

In an alternative embodiment, the inlet duct, however, connects substantially axially to the centrifugal chamber. Here a turbulator is arranged in the first end portion of the centrifugal chamber so that a mixture of air and lubricating oil and fuel, if any, which flows into the chamber, is put in the required circulating motion along the circumferential wall of the chamber.

In a variant of the engine with fuel injection, in which variant there is no fuel in the crankcase, the inlet duct is arranged to drain, by gravity, said lubricating oil back to the crankcase.

Preferably, the centrifugal chamber of the separator has, with respect to said circulating motion, an axially second end portion, in which the radially inner chamber outlet is formed. This solution adds to the compact design of the centrifugal chamber and can be further improved if a collar extends into the chamber from said second end portion, which collar surrounds the radially inner chamber outlet. The collar effectively prevents oil and fuel, if any, from flowing along a chamber end wall into this chamber outlet.

In a variant of the engine, in which variant there is fuel in the crankcase, said second end portion has, with respect to said circulating motion, a radially outer chamber outlet, which by a suction duct is connected to a suction port in the cylinder, which suction duct, due to the dynamics of liquids, suitably connects substantially tangentially to the centrifugal chamber. The centrifugal separator which is employed according to the invention can thus be efficiently used both for supply of air or a very lean, fuel-air mixture to the air inlet of the engine and a rich and, thus, ignitable fuel-air mixture to the suction port of the engine.

In that case, air inlets are preferably formed in the cylinder on both sides of the suction port, which air inlets are connected by air ducts to at least one separator. This is advantageous since a plurality of air inlets can significantly improve the so-called scavenging of the combustion chamber, which promotes considerably cleaner exhaust gases.

The air ducts are suitably each connected to a separator, which by a suction duct of its own is connected to one and the same suction port. Such a solution involving preferably two separators allows an extremely compact engine design with separators on both sides of the crank mechanism in the crankcase.

In a variant of the engine, in which variant fuel is not supplied to the cylinder through the separator, said second end portion has, with respect to said circulating motion, a radially outer chamber outlet, which by a return duct is connected to the crankcase. In this way, separated oil will be effectively returned to the crankcase. Preferably the return duct has an opening, which in the crankcase is formed in an eccentric part of a crank mechanism. In this way the rotation of the crank mechanism will throw the mixture of oil and air radially outwards from the centre of the crank mechanism and, thus, produce suction in the return duct which promotes increased return of oil to the crankcase.

BRIEF DESCRIPTION OF THE DRAWINGS

The invention will in the following be described in more detail with reference to the accompanying schematic drawings, in which.

DESCRIPTION OF PREFERRED EMBODIMENTS

Figure 1:
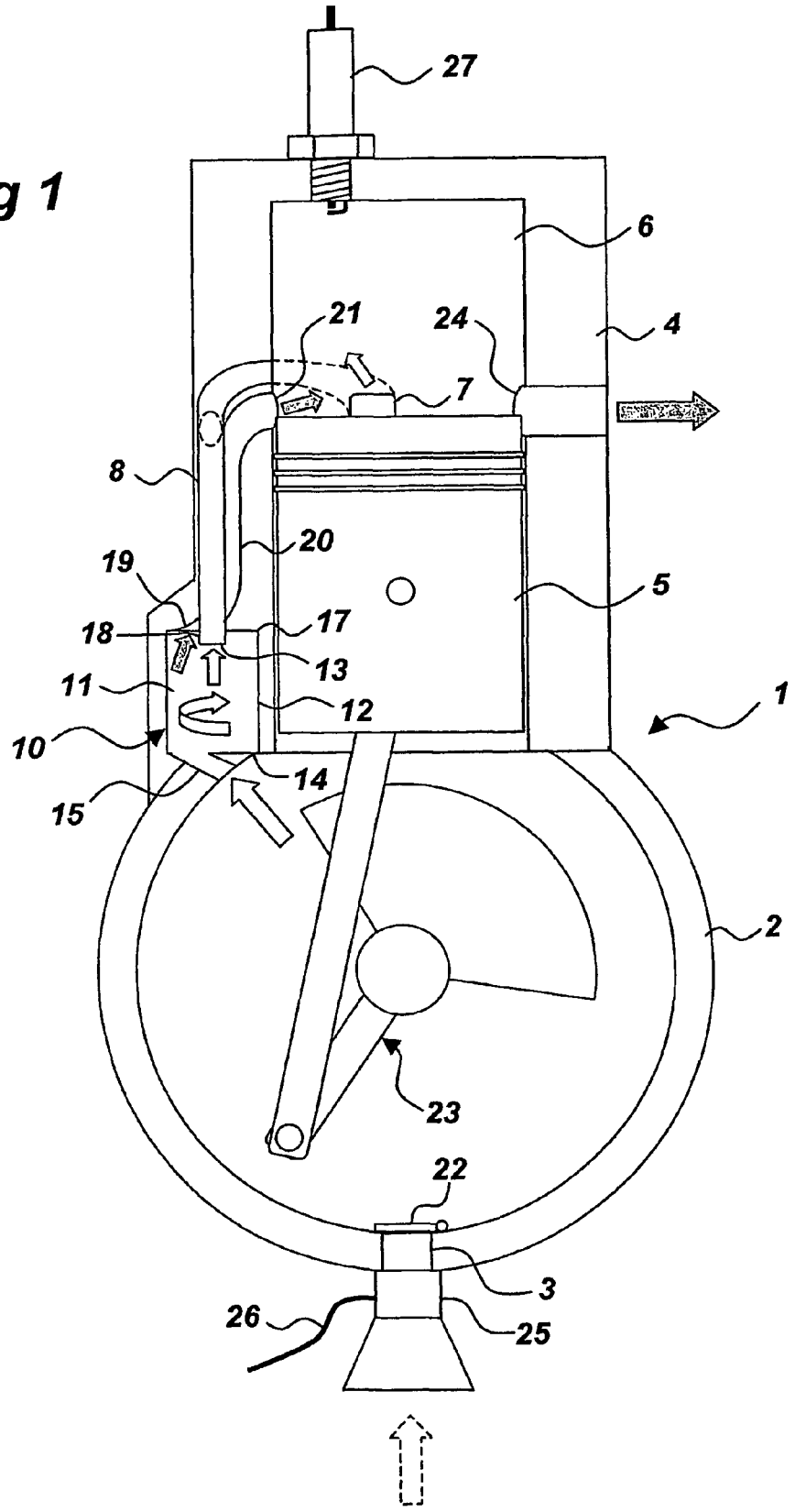
FIG. 1 shows, with partly broken-away portions, an engine according to the invention in a variant with a carburettor.
Figure 2:
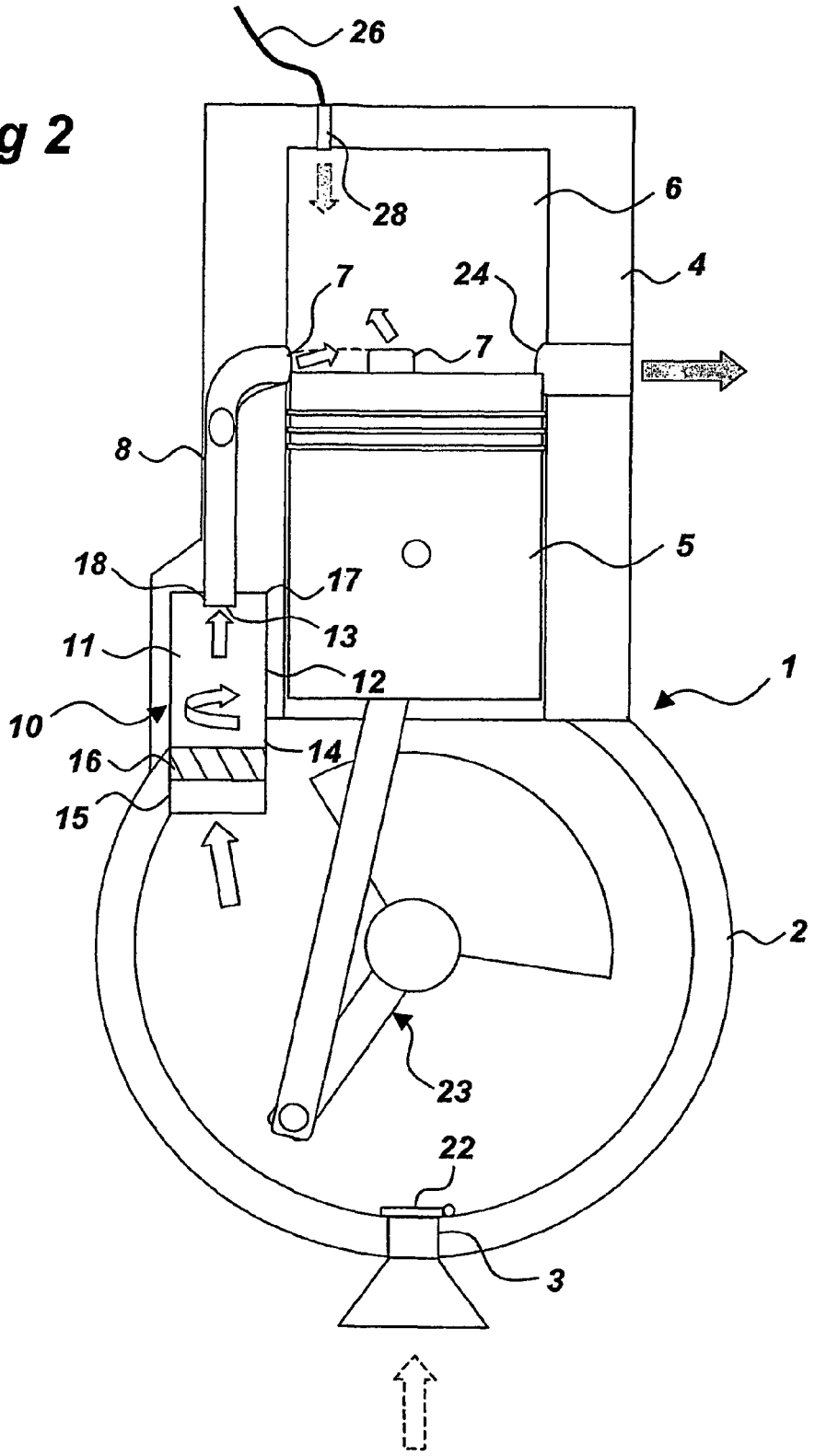
FIG. 2 shows, with partly broken-away portions, an engine according to the invention in a variant with direct injection.
Figure 3:
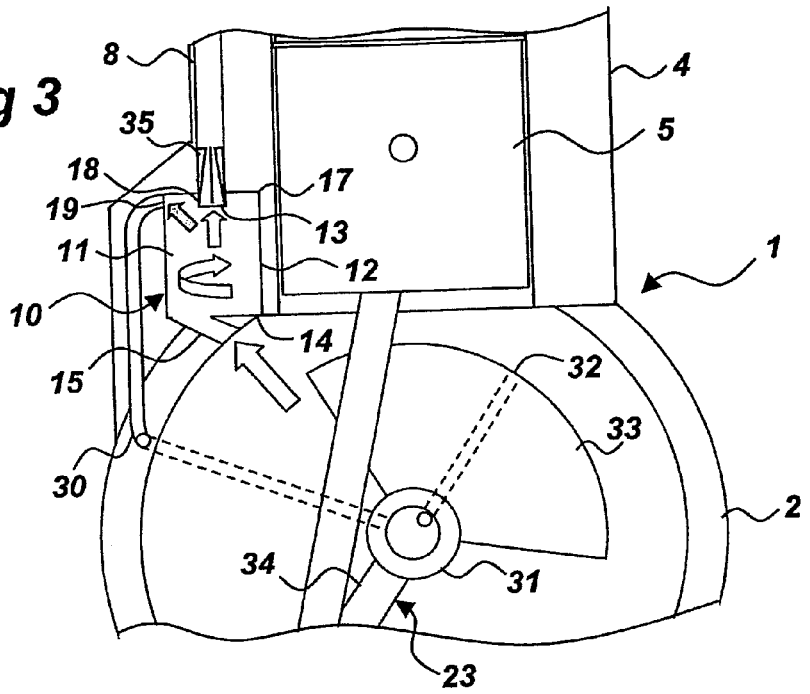
FIG. 3 shows, with partly broken-away portions, an engine according to the invention in a variant with return of oil to the crankcase.
Figure 4:
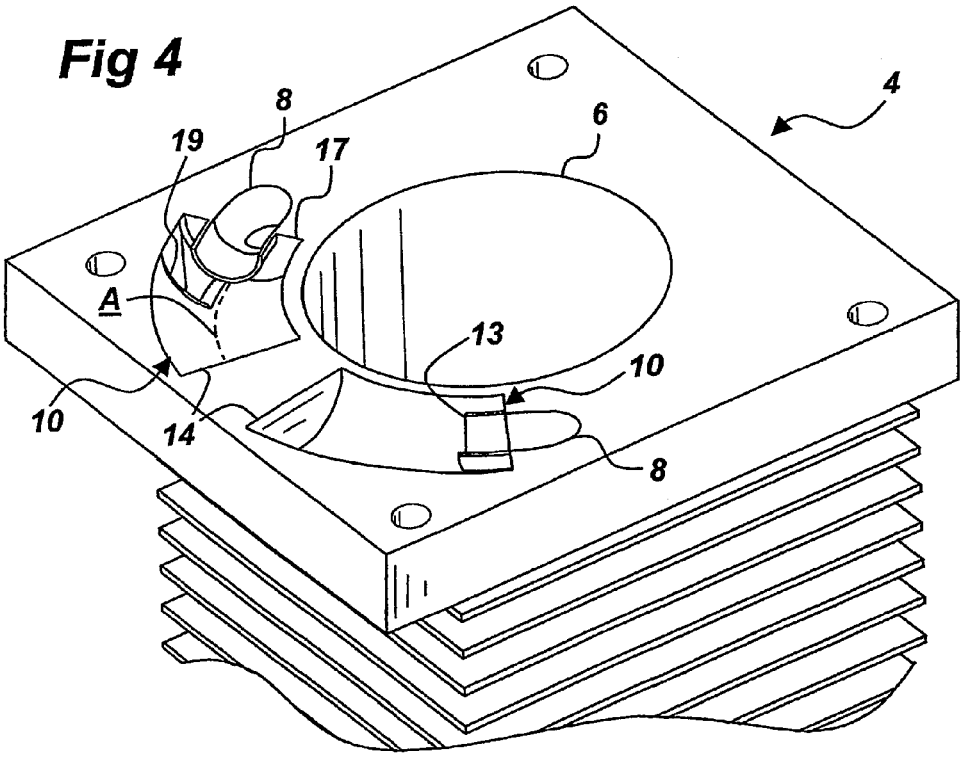
FIG. 4 shows, with partly broken-away portions, parts of an engine according to the invention.

For simplified reading, equivalent components are provided with the same reference numerals, FIGS. 1,2 and 3 showing two-stroke internal combustion engines 1 which have a crankcase 2 and a cylinder 4 connected to the crankcase 2, and FIG. 4 showing a cylinder 4 intended for such an engine 1.

The crankcase 2 has at the bottom (with reference to the situation shown in the drawings) an air intake 3, which by means of a valve flap 22 is opened at a negative pressure in the crankcase 2 and is closed at a positive pressure in the same. In the crankcase 2 there is in prior art manner a crank mechanism 23, which is connected to a piston 5.

The piston 5 is slidingly arranged in the cylinder 4 and, during sliding, opens and closes the openings that are formed in the cylinder 4. The openings are an exhaust gas port 24, air inlets 7 and, in the engine 1 in FIG. 1, a suction port 21.

The exhaust gas port 24 is in prior art manner connected to an exhaust pipe (not shown). The other openings are, however, in a way unique to the invention connected to a separator 10, which will be described below in more detail first for the engine variant shown in FIG. 1 and subsequently for the engine variant shown in FIG. 2.

The engine 1 in FIG. 1 is a two-stroke engine and is supplied with fuel by means of a carburettor 25. The carburettor 25 is connected to the air intake 3 and supplied with lubricated fuel through a fuel line 26. When in a first engine cycle (upward stroke of the piston 5) a negative pressure occurs in the crankcase 2, lubricated fuel, together with air, is sucked into the crankcase 2 and forms a mist therein consisting of air and atomised droplets of fuel and lubricating oil. When in a second engine cycle (downward stroke of the piston) a positive pressure occurs in the crankcase 2, the mist is forced out of the crankcase 2 through an inlet duct 15 to the separator 10.

In the embodiment in FIG. 1, the separator 10 comprises a circular-cylindrical centrifugal chamber 11, which at the bottom has an axially first end portion 14 and at the top has an axially second end portion 17, axially of course referring to the axial direction of the centrifugal chamber 11. Between the end portion 14, 17 extends the circumferential wall 12 of the chamber 11 in the form of a smooth homogeneous cylinder wall surface.

The inlet duct 15 connects substantially tangentially to the centrifugal chamber 11, which, as is evident from FIG. 1, does not prevent the inlet duct 15 from reaching the chamber 11 at an angle other than perpendicular to the axial direction of the chamber 11. The mist flowing into the centrifugal chamber 11 is, due to the tangential connection, put in a circulating motion inside the chamber 11, the heavier fuel and oil droplets being thrown by centrifugal forces outwards to the circumferential wall 12 of the chamber 11 and the lighter air remaining in the centre of the chamber 11.

It will be appreciated that the thus provided separation of fuel/oil and air is most distinct at a distance from the inlet duct 15, that is adjacent the axially second portion 17 of the centrifugal chamber 11. In this portion 17, two outlets are arranged, a radially inner or axial chamber outlet 13 and a radially outer chamber outlet 19.

The radially outer chamber outlet 19 is connected to a suction duct 20, which first extends substantially tangentially away from the centrifugal chamber 11 along an upward curve. This is a natural continuation of a helical line which extends helically along the circumferential wall 12 of the chamber 11 and which starts in the inlet duct 15 which is substantially tangential to the chamber 11. The other end of the suction duct 20 opens in the cylinder 4 adjacent the above-mentioned suction port 21, which, due to the separation of fuel/oil and air, is reached by a fairly rich, and thus ignitable, fuel-air mixture.

The radially inner or axial chamber outlet 13 is connected to an air duct 8, which extends away from the centrifugal chamber 17 in a direction that is substantially axial thereto. The air duct 8 has at its chamber opening a collar 18 which extends into the chamber 11 and which is adapted to serve as a further barrier against fuel and oil. The other end of the air duct 8 connects to said air inlet 7 in the cylinder 4. In the version shown, two such air inlets 7 are arranged, of which, however, the front one in the figure is broken away and indicated only by a branch of the air duct 7, which branch is shown in the form of a dashed oval.

In operation of the engine 1 in FIG. 1, the described separator 10 has the function of supplying to the cylinder chamber 6 through the suction port 21 a rich fuel-air mixture which can easily be ignited by a sparking plug 27 in the top of the cylinder 4 while simultaneously supplying through the air inlets 7 a very lean fuel-air mixture, which helps, with very small fuel losses, to flush out exhaust gases from a preceding combustion cycle through the exhaust gas port 24.

The engine 1 in FIG. 2 is also of a two-stroke type. In contrast to the engine in FIG. 1, in which the fuel-air mixture is ignited by means of a sparking plug 27, the engine 1 in FIG. 2 operates, however, with compression ignition. For this purpose, there is in the top of the cylinder 4 a fuel injector 28, which is arranged to atomise, in a prior art manner, fuel supplied through a fuel line 26.

Analogously to the solution in FIG. 1, there is however at the bottom of the crankcase (referring to the situation shown in the drawings) an air intake 3, through which air is sucked into the engine 1 during a first engine cycle (upward stroke of the piston 5) when a negative pressure occurs in the crankcase 2. In the engine 1 in FIG. 2, this air is, however, not mixed with fuel, but only to a certain extent with lubricating oil, which in a manner that is known and therefore not shown is injected into the crankcase for lubricating the engine 1. In the next engine cycle (downward stroke of the piston) a positive pressure occurs in the crankcase 2 and a mist of air and lubricating oil is forced out of the crankcase 2 through an inlet duct 15 to the separator 10.

Also in the embodiment in FIG. 2, the separator 2 comprises a circular-cylindrical centrifugal chamber 11, which at the bottom has an axially first end portion 14 and at the top an axially second end portion 17, axially once more relating to the axial direction of the centrifugal chamber 11. Between the end portions 14, 17 extends the circumferential wall 12 of the chamber 11 in the form of a smooth homogeneous cylinder wall surface, which continuously passes into an axial inlet duct 15, which is also circular-cylindrical and opens in the crankcase 2.

To produce a desirable circulating motion along the circumferential wall 12 of the chamber 11, the inlet duct 15 in FIG. 2 comprises a turbulator 16, which in arranged in the axially first end portion 14 of the centrifugal chamber 11 and substantially consists of a number of inclined guide plates. The circulating motion causes the heavier oil droplets to be thrown outwards by centrifugal forces to the circumferential wall 12, while the lighter air remains in the centre of the chamber 11.

The thus provided separation of oil and air increases with the distance from the inlet duct 15, that is closer to the axially second portion 17 of the centrifugal chamber 11. In this portion 17 there is in the embodiment in FIG. 2 a radially inner or axial chamber outlet 13 and, around the same, only a circular closed chamber end wall. Separated lubricating oil is collected at this end wall, forms an oils film and flows down along the circumferential wall 12 of the centrifugal chamber 11 and the inlet duct 15 back to the crankcase 2.

The radially inner or axial chamber outlet 13 is, in the embodiment in FIG. 2, connected to an air duct 8, which extends away from the centrifugal chamber 11 in a direction that is substantially axial to the same. Again the air duct 8 has, at its chamber opening, a collar 18, which extends into the chamber 11 and is adapted to serve as a further barrier, in this case only against oil. The other end of the air duct 8 is branched and connects to a plurality of air inlets 7 in the cylinder 4, of which a first is positioned opposite the exhaust gas port 24 and the others between the exhaust gas port 24 and the first air inlets 7. (Once more, the air inlet is not to be seen in the broken-away part of the cylinder 4).

In operation of the engine 1 in FIG. 2, the described separator 10 has the function of supplying to the cylinder chamber 6 through the air inlets 7 a very lean mixture consisting of air and, due to the separation in the separator, an extremely small amount of lubricating oil. The fuel, such as diesel, is in this engine 1 supplied by means of the fuel injector 28 and ignited when, during an upward stroke of the piston 5 in the cylinder chamber 6, it reaches by compression a temperature which exceeds the autoignition temperature of the fuel. Before the piston 7 reaches this ignition position, exhaust gases from a preceding combustion cycle will, however, be flushed out through the exhaust gas port 24 with very small oil losses.

The engine 1 in the embodiment in FIG. 3 is of essentially the same type as the engine in FIG. 2, but is, in contrast to the engine in FIG. 2, provided with a separator 10, which in the same way as in the engine 1 in FIG. 1, is provided with a radially outer chamber outlet 19. The chamber outlet 19 is connected to a return duct 30, which is adapted to return a mixture of oil and air to the crankcase 2.

The return duct 30 extends through the material of the cylinder 4 and the crankcase 2 to a first bearing for a first end of the crank shaft 31 included in the crank mechanism 23. The return duct 30 further extends along a path in the crank shaft 31 to an opening 32 toward the crankcase 2 positioned on a portion of the boundary surface of the crank shaft 31, said portion being eccentrically located relative to the axis of rotation of the crank shaft 31. In other words, the opening 32 may, as illustrated, be formed in a balancer 33 on the crank shaft 31 or in a crank arm 34 opposite the balancer 33. It will be appreciated that the returning effect increases with an increasing radial distance between the opening 32 of the return duct 30 in the crankcase 2 and the axis of rotation of the crank shaft 31.

Of course, the embodiments described above may be varied in different ways with the scope of the claims. For instance in an alternative to the separator 10 in FIG. 3, the return duct can thus be eliminated, and instead a return flow can be used in the same way as shown for the embodiment in FIG. 2, but through an inlet duct 15 of the type shown in FIGS. 1 and 3. Correspondingly, for instance also the separator 10 in FIG. 2 may be used for the engine 1 in FIG. 1 or 3, although, of course, supplemented with a suction duct 20 or return duct 30 connected to the separator 10.

In addition, it is conceivable to arrange in all separators 10 according to the invention a turbulence-damping means in the air duct 8, for instance in the form of small vanes 35 in the vicinity of the inlet 13 of the air duct 8 (see FIG. 3). The turbulence-damping means promotes more favourable flow conditions in the air duct 8 and the subsequent cylinder chamber 6 and, thus, a marginally improved efficiency of the engine 1.

It will be appreciated that it is also possible to arrange more than one separator 10, such as one on each side of the crankcase 3, thus on both sides of the crank mechanism 23. This is illustrated in FIG. 4, in which a solution with two separators 10 is shown, in section along a parting line across the cylinder 4. The separators 10 shown in FIG. 4 are of the same type as the separators in FIGS. 1 and 3, but have, in contrast to them, an axis A which is lying relative to the cylinder 4 and, besides, is curved around the cylinder chamber 6, so that an extremely compact solution is obtained.

It goes without saying that it is also possible to design the air intake 3 of the engine 1 in a manner other than shown and, if desired, arrange a plurality of air inlets 7 and suction ports 2.

The invention claimed is:

1. A two-stroke internal combustion engine, comprising a crankcase, which has an air intake, and at least one cylinder, which is connected to the crankcase and which, together with a piston arranged therein, defines a combustion chamber, the cylinder having at least one air inlet, which via an air duct communicates with the crankcase, in which a mixture of air and lubricating oil and fuel, if any, is contained, wherein the air duct is connected to the crankcase via a separator for cleaning of air coming from the crankcase from lubricating oil and fuel, if any, said separator having a centrifugal chamber, in which the lubricating oil and the fuel, if any, in a circulating motion are thrown outwards to a circumferential wall and thus substantially cleaned air is passed, through a chamber outlet, which with respect to said circulating motion is a radially inner outlet, to said air duct to be supplied to the combustion chamber through the air inlet; said centrifugal chamber of the separator having, with respect to said circulating motion, an axially first end portion connected to the crankcase by an inlet duct; said inlet duct being arranged substantially tangentially relative to said centrifugal chamber resulting in said circulating motion inside said centrifugal chamber along said circumferential wall thereof; said centrifugal chamber of the separator having, with respect to said circulating motion, an axially second end portion in which the radially inner chamber outlet is formed; said second end portion having, with respect to said circulating motion, a radially outer chamber outlet connected to the crankcase by a return duct.

2. An engine as claimed in claim 1, in which the inlet duct is arranged to drain by gravity said lubricating oil back to the crankcase.

3. An engine as claimed in claim 1, in which a collar extends from said second end portion into the centrifugal chamber, said collar surrounding the radially inner chamber outlet.

4. An engine as claimed in claim 1, in which said second end portion has, with respect to said circulating motion, a radially outer chamber outlet, which by a suction duct is connected to a suction port in the cylinder.

5. An engine as claimed in claim 4, in which the suction duct connects substantially tangentially to the centrifugal chamber.

6. An engine as claimed In claim 4, in which air inlets are formed in the cylinder on both sides of the suction port, said air inlets being connected by air ducts to at least one separator.

7. An engine as claimed in claim 6, in which the air ducts are each connected to a separator, which by a suction duct of its own is connected to one and the same suction port.

8. An engine as claimed in claim 1, in which said return duct has an opening, which in the crankcase is formed in an eccentric part of a crank mechanism.

9. An engine as claimed in claim 3, in which said second end portion has, with respect to said circulating motion, a radially outer chamber outlet, which by a suction duct is connected to a suction port in the cylinder.

10. An engine as claimed in claim 5, in which air inlets are formed in the cylinder on both sides of the suction port, said air inlets being connected by air ducts to at least one separator.

11. An engine as claimed in claim 1, in which the inlet duct is arranged to drain by gravity said lubricating oil back to the crankcase.

12. A two-stroke Internal combustion engine, comprising a crankcase which has an air intake, and at least one cylinder, which is connected to the crankcase and which. together with a piston arranged therein, defines a combustion chamber, the cylinder having at least one air inlet, which via an air duct communicates with the crankcase, in which a mixture of air and lubricating oil and fuel, if any, is contained, wherein the air duct is connected to the crankcase via a separator for cleaning of air coming from the crankcase from lubricating oil and fuel, if any, said separator having a centrifugal chamber, in which the lubricating oil and the fuel, if any, in a circulating motion are thrown outwards to a circumferential wall and thus substantially cleaned air is passed, through a chamber outlet, which with respect to said circulating motion is a radially inner outlet, to said air duct to be supplied to the combustion chamber through the air inlet; said centrifugal chamber of the separator having, with respect to said circulating motion, an axially first end portion connected to the crankcase by an inlet duct; said centrifugal chamber of the separator having, with respect to said circulating motion, an axially second end portion in which the radially inner chamber outlet is formed; said second end portion having, with respect to said circulating motion, a radially outer chamber outlet connected to the crankcase by a return duct; wherein the inlet duct connects substantially axially to the centrifugal chamber, a turbulator being arranged in the first end portion of centrifugal chamber so that a mixture of air and lubricating oil and fuel, if any, which flows into the centrifugal chamber, is put in a circulating motion along the circumferential wall of the centrifugal chamber.

* * * * *